US011718059B2

(12) United States Patent
Olcese et al.

(10) Patent No.: US 11,718,059 B2
(45) Date of Patent: Aug. 8, 2023

(54) PROCESS FOR FORMING A PAPER CONTAINER AND RELATED METHODS AND MATERIALS

(71) Applicant: DART CONTAINER CORPORATION, Mason, MI (US)

(72) Inventors: Chelsea Olcese, Farmington, MI (US); Ralph MacKenzie, Okemos, MI (US); Randy Lamie, Laingsburg, MI (US)

(73) Assignee: Dart Container Corporation, Mason, MI (US)

( * ) Notice: Subject to any disclaimer, the term of this patent is extended or adjusted under 35 U.S.C. 154(b) by 51 days.

(21) Appl. No.: 17/462,399

(22) Filed: Aug. 31, 2021

(65) Prior Publication Data

US 2021/0394478 A1 Dec. 23, 2021

Related U.S. Application Data

(63) Continuation of application No. 16/196,003, filed on Nov. 20, 2018, now abandoned.

(Continued)

(51) Int. Cl.
*B31B 50/62* (2017.01)
*B31B 50/16* (2017.01)

(Continued)

(52) U.S. Cl.
CPC ..... *B31B 50/624* (2017.08); *B31B 50/16* (2017.08); *B31B 50/28* (2017.08); *B31B 50/88* (2017.08);

(Continued)

(58) Field of Classification Search
CPC ..... B31B 50/624; B31B 50/16; B31B 50/28; B31B 50/88; B31B 2105/0022;

(Continued)

(56) References Cited

U.S. PATENT DOCUMENTS 2,082,323 A * 6/1937 Bussey ..... B31B 50/62 229/4.5
3,136,652 A 6/1964 Bicknell (Continued)

FOREIGN PATENT DOCUMENTS

CA 2973887 A1 8/2016
CN 107208379 A 9/2017

(Continued)

OTHER PUBLICATIONS

European Search Report for Counterpart EP182065060, dated Mar. 15, 2019.

(Continued)

*Primary Examiner* — Michael A Tolin
*Assistant Examiner* — Christopher C Caillouet
(74) *Attorney, Agent, or Firm* — McGarry Bair PC

(57) ABSTRACT

Processes, assemblies, and sleeve blanks for forming a two-piece paper container are provided in which the sleeve blank includes an adhesive printed onto the sleeve blank while the sleeve blank is still part of the paper web. The adhesive can optionally be printed onto the sleeve blank in-line with printing a graphic on the sleeve blank prior to providing the sleeve blank to a container forming machine that wraps and seals the sleeve blank to a bottom blank.

19 Claims, 5 Drawing Sheets

Related U.S. Application Data

(60) Provisional application No. 62/592,719, filed on Nov. 30, 2017.

(51) Int. Cl.

| | |
|---|---|
| ***B41M 3/00*** | (2006.01) |
| ***B65D 3/14*** | (2006.01) |
| ***B31B 50/28*** | (2017.01) |
| ***B31B 50/88*** | (2017.01) |
| *B31B 120/00* | (2017.01) |
| *B31B 110/10* | (2017.01) |
| *B31B 105/00* | (2017.01) |

(52) U.S. Cl.
CPC ..... *B41M 3/006* (2013.01); *B65D 3/14* (2013.01); *B31B 2105/0022* (2017.08); *B31B 2110/10* (2017.08); *B31B 2120/002* (2017.08)

(58) Field of Classification Search
CPC ..... B31B 2110/10; B31B 2120/002; B41M 3/006; B65D 3/14; B32B 50/16; Y10T 156/1062
See application file for complete search history.

(56) References Cited

U.S. PATENT DOCUMENTS

| | | | |
|---|---|---|---|
| 3,444,732 | A | 5/1969 | Robbins et al. |
| 3,826,701 | A | 7/1974 | Miller |
| 3,925,139 | A | 12/1975 | Simmons |
| 4,117,971 | A | 10/1978 | Itoh |
| 4,386,576 | A | 6/1983 | Johnson |
| 4,409,045 | A | 10/1983 | Busse |
| 5,494,716 | A | 2/1996 | Seung et al. |
| 5,654,039 | A | 8/1997 | Wenzel et al. |
| 5,773,131 | A | 6/1998 | Dettling |
| 5,776,619 | A | 7/1998 | Shanton |
| 5,837,383 | A | 11/1998 | Wenzel et al. |
| 5,897,411 | A | 4/1999 | Stark et al. |
| 5,989,724 | A | 11/1999 | Wittosch et al. |
| 6,265,040 | B1 | 7/2001 | Neale et al. |
| 6,416,829 | B2 | 7/2002 | Breining et al. |
| 6,531,196 | B1 | 3/2003 | Aho et al. |
| 6,536,657 | B2 | 3/2003 | Van Handel |
| 6,663,927 | B2 | 12/2003 | Breining et al. |
| 7,195,805 | B2 | 3/2007 | Breining et al. |
| 7,320,825 | B2 | 1/2008 | Morabito |
| 8,512,831 | B2 | 8/2013 | Katayama et al. |
| 8,597,733 | B2 | 12/2013 | Vonfelden |
| 9,017,520 | B2 | 4/2015 | Hayes |
| 9,028,921 | B2 | 5/2015 | Dandenault et al. |
| 9,114,900 | B2 | 8/2015 | Hougland et al. |
| 9,340,927 | B2 | 5/2016 | Heiskanen et al. |
| 9,670,621 | B2 | 6/2017 | Pang et al. |
| 9,732,474 | B2 | 8/2017 | Koenig et al. |
| 9,771,688 | B2 | 9/2017 | Pang et al. |
| 9,803,088 | B2 | 10/2017 | Iyer et al. |
| 9,863,094 | B2 | 1/2018 | Pang et al. |
| 2004/0131871 | A1 | 7/2004 | Lee et al. |
| 2004/0211510 | A1 | 10/2004 | Franko, Sr. |
| 2006/0051603 | A1 | 3/2006 | Cleveland et al. |
| 2006/0068212 | A1 | 3/2006 | Wilhoit et al. |
| 2008/0041021 | A1 | 2/2008 | Capasso et al. |
| 2009/0053541 | A1 | 2/2009 | Hutter et al. |
| 2010/0012712 | A1 | 1/2010 | Swoboda et al. |
| 2010/0301254 | A1 | 12/2010 | Jabar, Jr. et al. |
| 2011/0031305 | A1 | 2/2011 | Pounder et al. |
| 2011/0046284 | A1 | 2/2011 | Berube et al. |
| 2011/0262745 | A1 | 10/2011 | Ronka |
| 2012/0302660 | A1 | 11/2012 | Stanssens et al. |
| 2013/0021396 | A1 | 1/2013 | Hirano |
| 2013/0213962 | A1 | 8/2013 | Wolters et al. |
| 2013/0225744 | A1 | 8/2013 | Iyer et al. |
| 2014/0183198 | A1 | 7/2014 | Slack |
| 2015/0111011 | A1 | 4/2015 | Hoekstra et al. |
| 2016/0153149 | A1 | 6/2016 | Mongrain |
| 2016/0176143 | A1 | 6/2016 | Knauf et al. |
| 2016/0230343 | A1 | 8/2016 | Pang et al. |
| 2016/0340833 | A1 | 11/2016 | Pang et al. |
| 2016/0348318 | A1 | 12/2016 | Koenig et al. |
| 2017/0002517 | A1 | 1/2017 | Pang et al. |
| 2017/0182726 | A1 | 6/2017 | Lips |
| 2017/0225423 | A1 | 8/2017 | Knauf et al. |
| 2017/0225424 | A1 | 8/2017 | Weishew et al. |
| 2017/0328005 | A1 | 11/2017 | Parker et al. |
| 2018/0022932 | A1 | 1/2018 | Iyer et al. |
| 2018/0051418 | A1 | 2/2018 | Hayes et al. |
| 2018/0135251 | A1 | 5/2018 | Constant et al. |
| 2018/0142418 | A1 | 5/2018 | Sundholm et al. |

FOREIGN PATENT DOCUMENTS

| | | | |
|---|---|---|---|
| EP | 0718437 | A1 | 6/1996 |
| EP | 2868590 | A1 | 5/2015 |
| EP | 2870288 | A2 | 5/2015 |
| EP | 2358942 | B1 | 5/2016 |
| EP | 3256643 | A1 | 12/2017 |
| EP | 3265498 | A1 | 1/2018 |
| EP | 3286378 | A1 | 2/2018 |
| EP | 3294949 | A1 | 3/2018 |
| GB | 919065 | A | 2/1963 |
| JP | 2013212643 | A | 10/2013 |
| WO | 1996005054 | A1 | 2/1996 |
| WO | 2002053838 | A1 | 7/2002 |
| WO | 2005037568 | A1 | 4/2005 |
| WO | 2007140009 | A2 | 12/2007 |
| WO | 2009153389 | A1 | 12/2009 |
| WO | 2012170623 | A2 | 12/2012 |
| WO | 2014005697 | A2 | 1/2014 |
| WO | 2015003275 | A1 | 1/2015 |
| WO | 2015020749 | A1 | 2/2015 |
| WO | 2016130751 | A1 | 8/2016 |
| WO | 2016144799 | A1 | 9/2016 |
| WO | 2016170229 | A1 | 10/2016 |
| WO | 2016183314 | A1 | 11/2016 |

OTHER PUBLICATIONS

European Patent Office, Extended Searh Report Re Corresponding Application No. 20209649.1-1016, dated Feb. 24, 2021, 8 Pages, Munich, Germany.

* cited by examiner

PROCESS FOR FORMING A PAPER CONTAINER AND RELATED METHODS AND MATERIALS

CROSS-REFERENCE TO RELATED APPLICATIONS

This application is a continuation of U.S. patent application Ser. No. 16/196,003, filed Nov. 20, 2018, which claims the benefit of U.S. Provisional Patent Application No. 62/592,719, filed Nov. 30, 2017, both of which are incorporated herein by reference in their entirety.

BACKGROUND

Conventional two-piece paper containers are generally made by cutting sleeve blanks from a paper web, wrapping the sleeve blank around a forming mandrel, and securing the wrapped sleeve blank at a sidewall seam to form a sleeve that is sealed with a bottom blank for forming the two-piece container. Most two-piece containers are provided with a barrier coating on the paper to protect the paper from the contents of the container. For example, paper cups are often provided with a wax or polyethylene-based barrier coating which protects the paper from liquid contained within the cup. Some of the barrier coatings, such as polyethylene-based based coatings, also function as an adhesive for forming the sidewall seam and sealing the sleeve with the bottom.

For example, a conventional wax paper cup is made using a paper web that includes a printed graphic on one side and a wax coating that is not applied until after the cup is formed. The paper web is supplied to a cup forming machine where the sleeve blanks are cut from the paper web and a liquid glue is applied along two edges. The sleeve blank is then wrapped around a forming mandrel and a side seam clamp is used to apply pressure to seal the overlapping edges of the wrapped blank with the liquid glue to form the sleeve. Typically the same adhesive is used to then attach the bottom end of the sleeve to a bottom blank to form the cup. Once fully formed, a wax coating is applied to the cup.

Paper cups made using a paper web that includes a polyethylene-based coating, rather than a wax, do not require the step of applying a liquid glue at the cup forming machine. The polyethylene-based coating can provide sufficient adhesion for forming the side seam and sealing with the bottom blank without the application of an additional glue. Removal of the glue application station from the cup forming machine can allow the cups to be formed at a higher rate. However, in some cases, the use of a polyethylene-based coating on the paper web is not desirable. For example, cups made from paper that includes a polyethylene-based coating can be challenging to recycle.

BRIEF SUMMARY

Aspects of the present disclosure relate to an assembly and process for forming a container from a sleeve blank and a bottom blank that includes at least one adhesive printing station for printing an adhesive on a web, a blank cutting station for cutting the sleeve blank from the web, and a container forming station for wrapping the sleeve blank around the bottom blank, wherein the at least one adhesive printing station is provided upstream of the container forming station.

DETAILED DESCRIPTION

Figure 1:
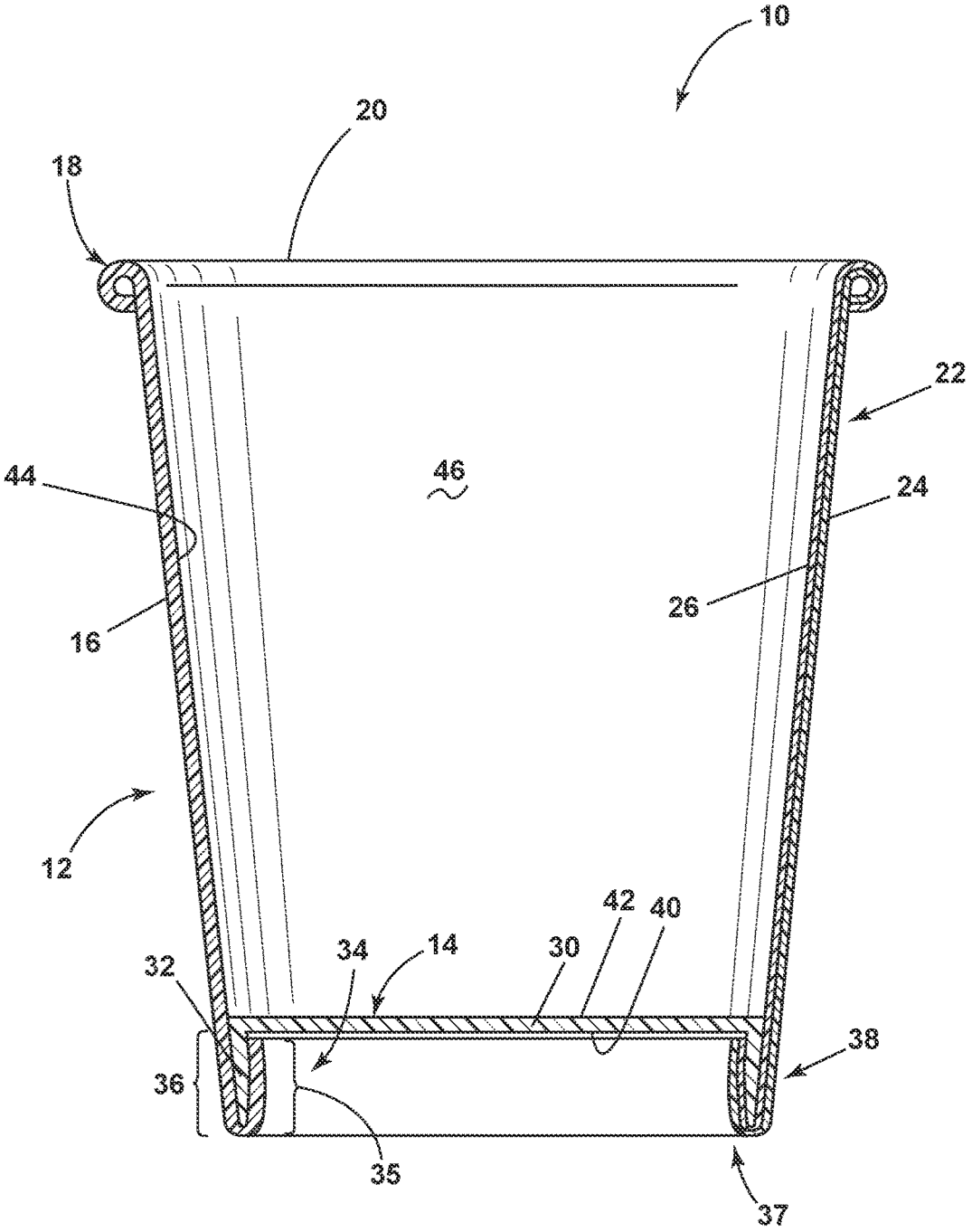
FIG. 1 is a cross-sectional view of a container according to an aspect of the disclosure.

Aspects of the present disclosure relate to processes for forming a two-piece paper container made by wrapping a paper sleeve blank around a paper bottom blank that can take advantage of the high container forming rates available with current container forming machines. While aspects of the present disclosure are discussed in the context of a cup, additional container types, such as bowls and storage containers, including those suitable for use in food service, are also contemplated.

Conventional two-piece paper containers are made by cutting a sleeve blank and a bottom blank from suitable paper substrates (also referred to as a paper web). The sleeve blank and bottom blank are assembled by a container forming machine to form the container defining a cavity for holding material. The container forming machine generally includes a mandrel about which the sleeve blank is wrapped and overlapping side edges of the sleeve blank are adhered together to form a sleeve. A bottom edge of the sleeve is adhered to the bottom blank to seal the sleeve with the bottom blank and thus form the container. Thus, the process of forming the two-piece paper container involves the use of an adhesive both in forming the sleeve and in sealing the sleeve with the bottom blank.

These conventional two-piece paper containers are typically made from paper stock that has been coated with a polyethylene-based coating. The polyethylene-based coating acts as a barrier coating that provides protection to the paper from the contents of the container (e.g. liquids, grease). The polyethylene-based coating is also heat-sealable and thus can also function as the adhesive for securing the overlapping side edges of the sleeve blank and sealing the sleeve with the bottom blank at the container forming machine. The container forming machine is configured to apply heat and/or pressure at specific locations of the sleeve and bottom blanks to form an adhesive seal with the polyethylene-based coating that provides an adhesive sidewall seam (also referred to as a seam seal or a sidewall seal) where the side edges of the sleeve blank overlap and to form a bottom seal between the sleeve and the bottom blank.

Containers that are made using paper stock that does not include a polyethylene-based coating can require the use of an adhesive to form a suitable sidewall seam and bottom seal. For example, wax containers (i.e., containers that include a wax barrier coating on the paper that is typically applied to the paper stock after forming the container), generally include the additional step of adding an adhesive to the paper blanks on the container forming machine to form the sidewall seam and the bottom seal. This additional adhesive applying step limits the rate at which the container forming machine can form the waxed containers compared to the polyethylene-based coated containers discussed above, which do not require the additional adhesive applying step. Other types of coatings, such as aqueous-based barrier coatings may also require the additional adhesive applying step to provide an adhesive that can form a suitable sidewall seam and bottom seal, thus limiting the rate at which containers can be formed using these types of barrier coatings.

Aspects of the present disclosure relate to printing an adhesive on the sleeve blank while it is still in the web prior to sending the sleeve blank to the container forming machine where the sleeve blank is wrapped around a mandrel to form the sleeve, which is then sealed with the bottom blank to form the container. In one aspect, the paper web containing the sleeve blanks with the pre-printed adhesive can be stored as a pre-printed adhesive roll for supplying to the container forming machine. In another aspect, the pre-printed adhesive sleeve blanks can be cut from the web and supplied to the container forming machine as pre-cut, pre-printed adhesive sleeve blanks.

In this manner, the rate of application of the adhesive is not a rate limiting step in the container forming process. Because the adhesive has been printed onto the sleeve blank prior to the sleeve blank being provided to the container forming machine, the container forming machine does not have to include an additional adhesive applying step, which would limit the rate at which the containers are formed on the machine. In this manner, polyethylene-based coating-free containers (for example, waxed containers or aqueous-based coated containers), can be formed on a container forming machine at production rates comparable to that of a polyethylene-based coated container. As used herein, comparable rates are within about plus/minus 20%, optionally about plus/minus 15%, further optionally about plus/minus 10%.

According to another aspect of the present disclosure, the adhesive is printed on the sleeve blank in-line with the printing of graphics on the sleeve blank prior to supplying the sleeve blank to the container forming machine. In one aspect, the adhesive is printed using flexography or gravure printing to apply the adhesive to defined portions of the sleeve blank such that the cavity of the formed container is free of the adhesive.

FIG. 1 illustrates an exemplary container 10 according to an aspect of the present disclosure in the form of a cup. While aspects of the present disclosure are discussed in the context of the cup, the container 10 can have any desired shape and size and can optionally be suitable for food service. Container 10 can be in the form of a two-piece cup that includes a sleeve 12 and a bottom 14. The sleeve 12 includes a portion defining a sidewall 16 of the container 10. A rim 18 defines an open end 20 of the sleeve 12 at an upper end of the sleeve 12. The rim 18 may optionally be rolled, bent, curled, or crimped in a conventional manner. A sidewall seam 22 is formed where overlapping side edges 24, 26 of the sleeve 12 are adhered together to form a sidewall seam, also referred to as a sidewall seal.

A bottom portion of the sleeve 12, opposite the rim 18, is sealed with the bottom 14 by an adhesive. The bottom 14 includes a bottom wall 30 and a depending skirt 32. The sleeve 12 includes a portion defining a flange 34 that is wrapped around the skirt 32 of the bottom 14 such that the skirt 32 is sandwiched between an inner flange portion 35 and an outer flange portion 36. The wrapped skirt 32 defines a foot 37, opposite the rim 18, which supports the container 10 on a surface. An adhesive forms a seal between the flange 34 on both sides of the skirt 32 to form a bottom seal 38 between the sleeve 12 and the bottom 14.

The bottom wall 30 includes an outer surface 40 facing the foot 37 and an opposing inner surface 42. The inner surface 42 of the bottom wall 30 together with an inner surface 44 of the sidewall 16, above the bottom wall 30, together define a container cavity 46. The inner surfaces 42 and 44 define the surfaces of the container 10 that are exposed within the container cavity 46 and may come into contact with material contained within the container cavity 46.

Optionally, the container 10 can be a flat-bottom type container, rather than the illustrated raised bottom (also referred to as a pot-type container), in which the bottom 14 does not include a skirt and the flange 34 is wrapped and sealed under the bottom wall 30. The flat-bottom type container can have a bottom wall that is generally flat or has a curved portion.

Figure 2:
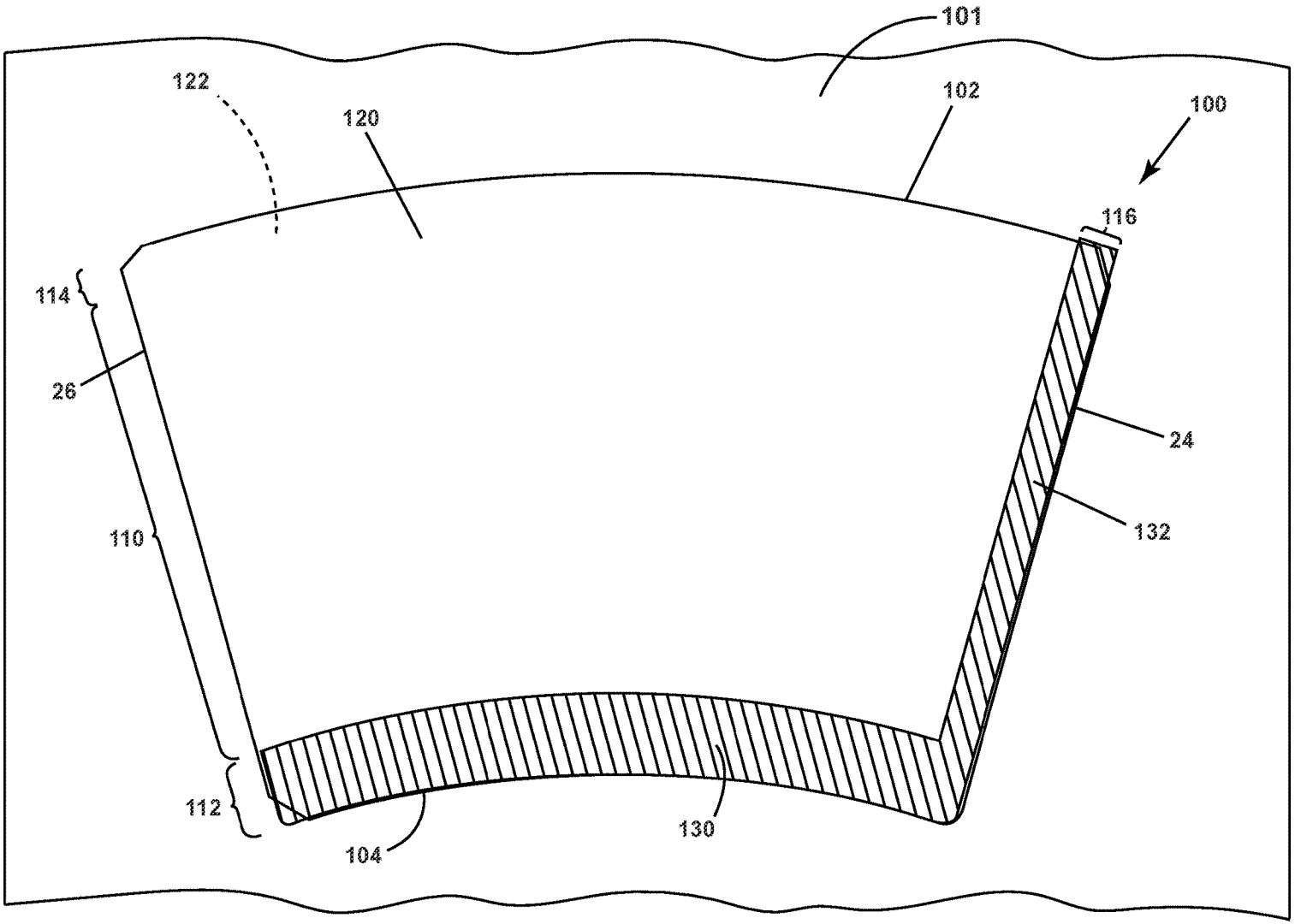
FIG. 2 is a top-down view of a sleeve blank according to an aspect of the present disclosure.

Referring now to FIG. 2, the sleeve 12 is formed from a sleeve blank 100 that can be cut from a sheet or web of paper stock 101. The sleeve blank 100 includes the opposing first and second side edges 24 and 26, a top edge 102 extending between the side edges 24 and 26 at an upper portion of the sleeve blank 100, and a bottom edge 104 extending between the side edges 24 and 26 at a lower portion of the sleeve blank 100, opposite the top edge 102.

The sleeve blank 100 can be considered as having multiple portions that each form a different portion of the assembled container 10. The sleeve blank 100 includes a cavity portion 110 that corresponds to the inner surface 44 of the sidewall 16 that defines the cavity 46 of the container 10, a bottom portion 112 corresponding to the portion that defines the flange 34 that wraps around the skirt 32, and a top portion 114 corresponding to the rim 18. The sleeve blank 100 also includes a seam portion 116 that extends along at least a portion of the side edge 24 between the top and bottom edges 102 and 104. The relative dimensions of the cavity portion 110, the bottom portion 112, the top portion 114, and the seam portion 116 can vary based on the dimensions and structure of the container 10 that is to be formed. The cavity portion 110 can be defined as extending between the bottom portion 112, the top portion 114, and the seam portion 116.

The sleeve blank 100 also includes a first surface 120 and an opposing second surface 122. The sleeve blank 100 can be wrapped to form the sleeve 12 such that the first surface 120 forms an interior surface which faces a central axis of the formed container 10 and the opposing second surface 122 forms an exterior surface which faces outward, away from the central axis of the formed container 10. Optionally, the sleeve blank 100 can be wrapped to form the sleeve 12 such that the first surface 120 forms the exterior surface and the second surface 122 forms the interior surface.

According to an aspect of the present disclosure, the sleeve blank 100 includes a first printed adhesive applied to the bottom portion 112 corresponding to the flange 34 to form a printed adhesive bottom flange portion 130 and a second printed adhesive applied to the seam portion 116 to form a printed adhesive seam portion 132. The printed adhesive bottom flange portion 130 is configured to adhesively seal to the skirt 32 in the formed container 10 to form the bottom seal 38 between the sleeve 12 and the bottom 14. The printed adhesive seam portion 132 is configured to adhesively seal the overlapping side edges 24, 26 to form the sidewall seam 22. Optionally, when the container 10 is in the form of a flat-bottom type cup which does not include a skirt 32, the adhesive flange portion 130 is configured to adhesively seal to the bottom wall 30.

The first and second printed adhesives are applied along two, intersecting edges of the sleeve blank 100. The second printed adhesive is applied along whichever of the side edges 24, 26 overlaps the other on the second surface 122 of the sleeve blank 100. The first printed adhesive can be applied along the bottom portion 112 along the entire distance between the side edges 24, 26 or only a portion of the distance between the side edges 24, 26. The first printed adhesive can extend all the way to one or both of the side edges 24, 26 or be offset from one or both of the side edges 24, 26. The first printed adhesive can be printed as a strip having a length extending between the side edges 24, 26 and a width defined as the dimension extending between the top and bottom edges 102, 104. The first printed adhesive can extend all the way to the bottom edge 104 or be offset from the bottom edge 104.

Optionally, the first printed adhesive can be printed as multiple strips rather than a single strip. The multiple strips can be printed along the bottom portion 112 such that the first printed adhesive comes into contact with portions of the skirt 32 on both sides of the skirt 32, but the adhesive does not wrap around the entire skirt 32. For example, the first printed adhesive can be applied as two strips such that an adhesive seal is formed between the flange 34 and the skirt 32 on both sides of the skirt 32, but no adhesive is printed on the portion of the sleeve blank 100 that is adjacent the distal end of the skirt 32. Applying the first printed adhesive as multiple strips, rather than a single strip can reduce the amount of adhesive used while still providing adhesive where it is needed in order to form the desired seal between the flange 34 and the skirt 32.

The second printed adhesive can be applied along the seam portion 116 along the entire distance between the top and bottom edges 102, 104 or only a portion of the distance. The second printed adhesive can extend all the way to one or both of the top and bottom edges 102, 104 or be offset from one or both of the top and bottom edges 102, 104. The second printed adhesive can be printed as a strip having a length extending between the top and bottom edges 102, 104 and a width defined as the dimension extending between the side edges 24, 26. The second printed adhesive can extend all the way to the side edge 24 or can be offset from the side edge 24. Optionally, the second printed adhesive can be applied to the side edge 26 in a similar manner.

The first and second printed adhesives can be the same or different and can be heat and/or pressure activated. As used herein, a heat activated adhesive refers to an adhesive that requires exposure to temperatures above ambient to form an adhesive bond. Heat activated adhesives are generally in a non-tacky state until heat is applied and the adhesive is transformed into a tacky state capable of forming an adhesive bond with a suitable substrate. A pressure activated adhesive, also referred to as a pressure sensitive adhesive, can be in a tacky state without the addition of heat and forms an adhesive bond with a suitable substrate when pressed together with the substrate. Non-limiting examples of suitable adhesives for printing along the bottom portion 112 and the seam portion 116 include CK-5791 and CK57CP, both commercially available from Cork Industries, Inc., U.S.A. Other example adhesives include acrylic co-polymer dispersion based adhesives, such as NeoCryl® FL-721 XP and NeoCryl® FL-721, both commercially available from DSM, U.S.A. Additional suitable adhesives include aqueous polyethylenimine based adhesives, examples of which include MICA H-788, available from MICA Corporation, U.S.A., Polymin® P, available from BASF Corporation, U.S.A. The first and second printed adhesives can be selected based on the paper stock used for the sleeve blank 100, the intended material to be held by the container (e.g. cold cup or hot cup), and/or the paper stock treatment or coatings.

In one aspect of the present disclosure, the sleeve blank 100 can be made from a solid bleached sulfate (SBS) paperboard paper stock or other paper stock suitable for forming containers. An example of a suitable paper stock is the TruServ™ brand of cupstock grades, available from WestRock, U.S.A. Table 1 lists examples of suitable paper stock for different cup sizes according to an aspect of the disclosure.

TABLE 1

Example paper stock for sleeve blanks

| Paper stock | Hot Cup Size | Caliper-Thickness (inches) | Basis Weight (lbs/3000 $ft^2$) |
|---|---|---|---|
| TruServ ™ (WestRock) | 16 oz. and 20 oz. | 0.0180 | 185 |
| TruServ ™ (WestRock) | 4 oz. | 0.0124 | 126 |
| TruServ ™ (WestRock) | 6 oz. | 0.0153 | 165 |
| TruServ ™ (WestRock) | 8 oz. and 12 oz. | 0.0165 | 175 |
| TruServ ™ (WestRock) | 24 oz. | 0.02 | 210 |

According to one aspect of the present disclosure, the side of the paper stock that forms the interior surface of the sleeve blank 100 is provided with a polyethylene-free barrier coating before or after cutting the sleeve blanks 100. Examples of suitable polyethylene-free barrier coatings include wax-based barrier coatings, such as natural and/or biodegradable wax coatings, polylactic acid (PLA) based barrier coatings, and aqueous-based barrier coatings that are suitable for food service. Optionally, the barrier coating can be applied after the container 10 is formed. For example, some wax containers are formed in a process that includes applying the wax coating to the formed container. The paper stock can include the same or different coatings on both sides of the paper.

According to one aspect of the present disclosure, the first and second printed adhesives are applied to the bottom and seam portions 112 and 116 of the sleeve blank 100, respectively, using flexography (also referred to as flexographic printing) or gravure printing prior to cutting the sleeve blank 100 from the paper web 101. Flexography and gravure printing allow the adhesive to be printed onto the sleeve blank 100 with a high degree of precision and consistency. According to one aspect, printing the adhesive onto the first surface 120 of the sleeve blank 100 occurs in-line with printing graphics on the second surface 122 of the sleeve blank 100. As used herein, graphics includes a blank registration or index mark that is used for alignment of the web during cutting of the sleeve blank and/or text, symbols, images, pictures, and/or artwork.

The first and second printed adhesive portions 130, 132 can be printed together as a single pattern or as two separate strips, which optionally intersect or overlap. According to one aspect, the first and second printed adhesive portions 130, 132 are printed such that the first and second adhesives do not extend into the cavity portion 110 of the sleeve blank, i.e. the cavity portion 110 is free of the first and second printed adhesives. For example, the second printed adhesive portion 132 can be printed in register with at least one of the side edges 24, 26, such that when the sleeve blank 100 is wrapped to form the seam seal, the printed adhesive does not extend beyond the at least one side edge 24, 26 into the container cavity 46. Optionally, the first printed adhesive portion 130 can be printed in register with the bottom edge 104 such that when the sleeve blank 100 is wrapped around the bottom 14 to form the bottom seal, the printed adhesive does not extend beyond the bottom wall 30 in to the container cavity 46. In this manner, the cavity 46 of the formed container 10 is free of adhesive. While the cavity 46 is free of adhesive, the contents of the cavity 46 may come into contact with the first and/or second adhesives if the contents seep in-between the overlapping side edges 24, 26 and/or the overlapping flange 34 and skirt 32.

Figure 3:
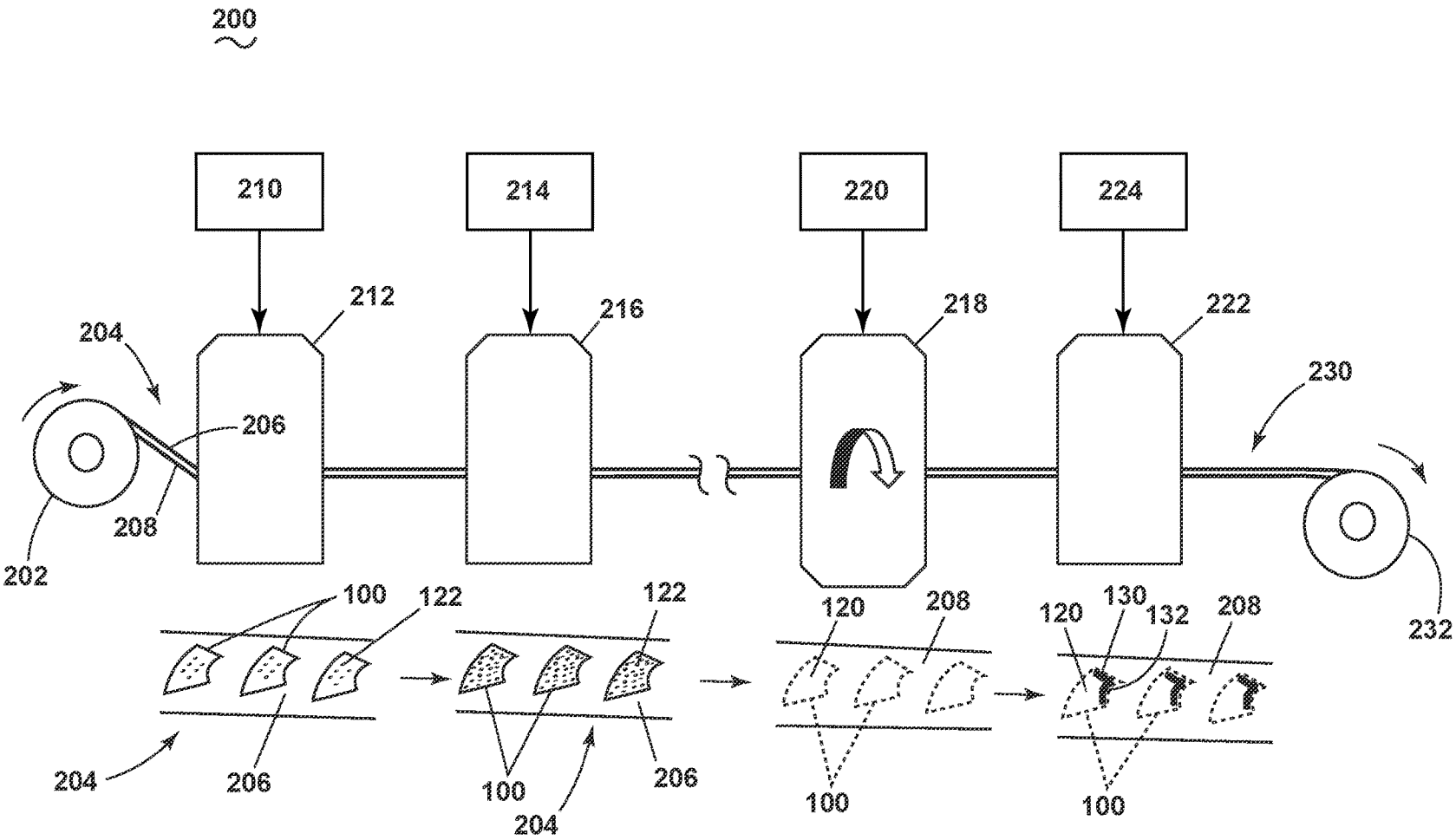
FIG. 3 is a schematic of a process of forming a sleeve blank according to an aspect of the present disclosure.

FIG. 3 illustrates a printing assembly process 200 according to an aspect of the disclosure by which the sleeve blank 100 having the first and second printed adhesive portions 130, 132 are formed. The process 200 is provided for illustrative purposes and may proceed in a different logical order or additional or intervening steps may be included, unless otherwise noted. While the process 200 is described in the context of forming the container 10, the process 200 may be used in a similar manner to form other types of two-piece paper containers.

The process 200 begins with a roll 202 of paper stock suitable for forming the sleeve blank 100. The roll 202 is unwound to provide a web 204 having a second side 206 that ultimately forms the second surface 122 of the sleeve blank 100 and a first side 208 that ultimately forms the first surface 120 of the sleeve blank 100. The process 200 is described within the context of the second surface 122 forming the exterior surface of the container 10 and the first surface 120 forming the interior surface of the container 10, although it is within the scope of the present disclosure for the process 200 to be used in a similar manner if the first and second surfaces 120, 122 are reversed, depending on how the sleeve blank 100 is to be folded.

According to one aspect, the paper stock is made on a traditional Fourdrinier paper machine that produces a web having a felt side and a wire side. The felt side is generally smoother than the wire side, which can have a more textured surface. The felt side can form the second side 206 to provide a smoother surface for printing graphics whereas the wire side can form the first side 208 on which the adhesives are printed.

At 210, the web 204 passes through a first ink printing station 212 which applies a first ink application to the second side 206 of the web 204. Optionally, at 214, the web 204 can pass through a second ink printing station 216 which applies a second ink application to the second side 206 of the web 204. The ink can be applied on the web 204 in register with the portions of the web 204 in which the sleeve blank 100 is to be cut from. Ink can be printed on the web adjacent to and/or on the portions of the web 204 that will form the sleeve blank 100.

The number of ink printing stations 212, 216 utilized may depend on the complexity of the graphic, the type of ink used, the number of different color(s) of ink used, etc. to provide the container 10 with the desired final graphic. Each ink printing station 212, 216 is configured to provide ink to the web 204 such that the desired graphic is displayed on each sleeve blank 100 cut from the web 204. While two ink printing stations 212, 216 are illustrated, according to an aspect of the present disclosure, the process 200 can include fewer or greater ink printing stations. For example, if the cup graphic includes 3 different colors, each color can be applied in a separate ink printing station.

According to one aspect, the web 204 has a width such that a single column of sleeve blanks 100 is formed in the web 204 (shown). Optionally, the web 204 can have a width such that multiple, side-by-side columns of sleeve blanks 100 are formed in the web 204.

Subsequent to the final ink printing station 216, the web 204 can be passed through a turn-bar station 218 at 220. The turn-bar station 218 flips the web 204 to expose the first side 208 of the web 204. The web 204 then passes through an adhesive printing station 222 at 224 to print adhesive on the first surface 120 of the sleeve blanks 100 in register with the graphics printed on the second surface 122. The adhesive can be printed on the first surface 120 of the sleeve blanks 100 along the bottom portion 112 to form the first printed adhesive bottom flange portion 130 and along the seam portion 116 to form the second printed adhesive seam portion 132 along the bottom portion 112.

The thus formed printed web 230 including the ink printed graphic on the second side 206 and the printed adhesive on the first side 208 can then be wound on a roll 232 for storage prior to cutting the sleeve blanks 100 from the printed web 230. Optionally, the printed web 230 can be passed through a cutting station (not shown) to cut the sleeve blanks 100 from the printed web 230 and the pre-cut sleeve blanks 100 can be stored for later use by a container forming machine to form the container 10.

While the process 200 is illustrated as including a single adhesive printing station 222 for printing the adhesive along the bottom portion 112 and the seam portion 116 of the sleeve blank 100, the process optionally includes two or more adhesive printing stations for printing an adhesive along each of the bottom portion 112 and the seam portion 116 in separate stages. According to one aspect of the present disclosure, multiple adhesive printing stations 222 may be used to print an adhesive such that the final amount of printed adhesive has a greater thickness. Water-based adhesives require adequate drying time prior to reaching the next printing station and prior to the web being wound onto a roll. If the adhesive is not dry enough, the adhesive may build-up on subsequent printing plates and/or offsetting (unintended transfer of the adhesive from the surface it was printed on to a subsequent surface it comes in contact with) may occur if the web is wound before the adhesive has sufficiently dried. This may result in unwanted adhesive on the interior surfaces of the container 10 that could flake off into the material contained by the container 10. Printing multiple layers of adhesive to provide the desired total thickness of adhesive rather than printing a single layer having the desired thickness can minimize/avoid these challenges without significantly impacting overall printing speed. The use of flexographic printing allows the location and the amount of each of the multiple layers of adhesive to be printed accurately, precisely, and consistently.

Optionally, multiple adhesive stations can be used to print different adhesives along the bottom portion 112 and the seam portion 116.

Each of the ink printing stations 212, 216 and the adhesive printing station 222 utilize flexography or gravure printing to print the ink and the adhesive in register on each side of the printed web 230. When the sleeve blanks 100 are cut from the printed web 230, each sleeve blank 100 includes printed graphics on the second surface 122 and printed adhesive on the first surface 120 in desired alignment with the edges 24, 26, 102, and 104 of each sleeve blank 100. Providing the adhesive printing station 222 in-line with the ink printing stations 212, 216 facilitates rapidly creating the printed web 230 and printing the adhesive in the desired positions on the sleeve blank 100.

Optionally, the adhesive printing station 222 can be configured to print the adhesive onto the underside of the web 204 without flipping the web 204. In this configuration, the turn-bar station 218 would not be necessary. Optionally, other systems may be utilized to flip the web 204 for printing on both sides.

Separate steps for printing the graphic and applying an adhesive can present opportunities for misalignment as the paper web is transferred to different machine stations. Providing a turn-bar station 218 to flip the paper web between the ink printing station 216 and the adhesive printing station 222 removes the need to transfer the paper web to separate machines for applying the adhesive. Printing the graphics and the adhesive in-line minimizes opportunities for misalignment and damage to the paper web that can occur when the paper web is removed from one machine station and then transferred and set-up on a different machine station. Printing the graphics and the adhesive on printing stations in-line can also increase the rate at which the sleeve blank 100 with graphics and printed adhesive can be formed compared to a process in which the ink printing and the adhesive are applied at different machine stations.

In addition, application of the adhesive using flexography or gravure printing is more precise and consistent than traditional methods of applying adhesives on the container forming machine. For example, a conventional glue wheel used to apply a glue at the container forming machine can transfer from the paper to the forming mandrels and build-up of glue on parts of the container forming machine (e.g., the forming mandrels and clamps) can require frequent cleaning. Conventional glue wheels can apply glue unevenly or even skip areas, resulting in an unacceptable seal. Printing the adhesive using flexography or gravure printing to apply the adhesive to the desired location on each sleeve blank prior to the container forming machine according to the present disclosure can avoid or mitigate many of these challenges associated with conventional glue application at the container forming machine.

The accuracy and precision of flexography or gravure printing for printing the adhesive facilitates applying the desired amount of adhesive where it is needed to form an acceptable sidewall seam and bottom seal while decreasing waste as a result of applying adhesive where it is not needed or at a higher amount than is needed. This level of control for applying the adhesive can contribute to higher production rates and lower production costs.

According to one aspect of the present disclosure, flexography or gravure printing is utilized to print the printed adhesive bottom flange portion 130 and the printed adhesive seam portion 132 in a predetermined amount on each sleeve blank 100 in the desired location in register with the graphic printed on the second surface 122 of the sleeve blank 100. An exemplary paper sleeve blank for a 16 ounce hot cup having a sleeve height of about 6 inches and a maximum sleeve width of about 11 inches can have a total printed adhesive amount of about 0.5% by weight (wt. %) of the formed cup. According to one aspect, the adhesive weight used in the example 16 ounce hot cup is about 4 lb/3000 $ft^2$, which corresponds to 2 lb/3000 $ft^2$ applied twice. In another example, 2 lb/3000 $ft^2$ may be applied once to the sleeve blank 100.

In one aspect, the amount of adhesive applied to the sleeve blank can be in the range of about 0.2 to about 0.7 wt. % of the finished container (i.e., sleeve plus bottom). According to one aspect, the range of about 0.2 to about 0.7 wt. % corresponds to cup sizes ranging from 8 to 24 ounce hot cups having a barrier coating applied to only the interior side of the sleeve and 12 to 24 ounce cold cups having a barrier coating applied both sides of the sleeve.

The second printed adhesive seam portion 132 can have a width corresponding to the amount of overlap of the side edges 24, 26, and the first printed adhesive bottom flange portion 130 can have a width corresponding to the amount of the flange 34 required to wrap around the skirt 32. For example, for the 16 ounce hot cup sleeve, the second printed adhesive seam portion 132 can have a width of about 0.5 inches and the first printed adhesive bottom flange portion 130 can have a width of about 0.8 inches.

Figure 4:
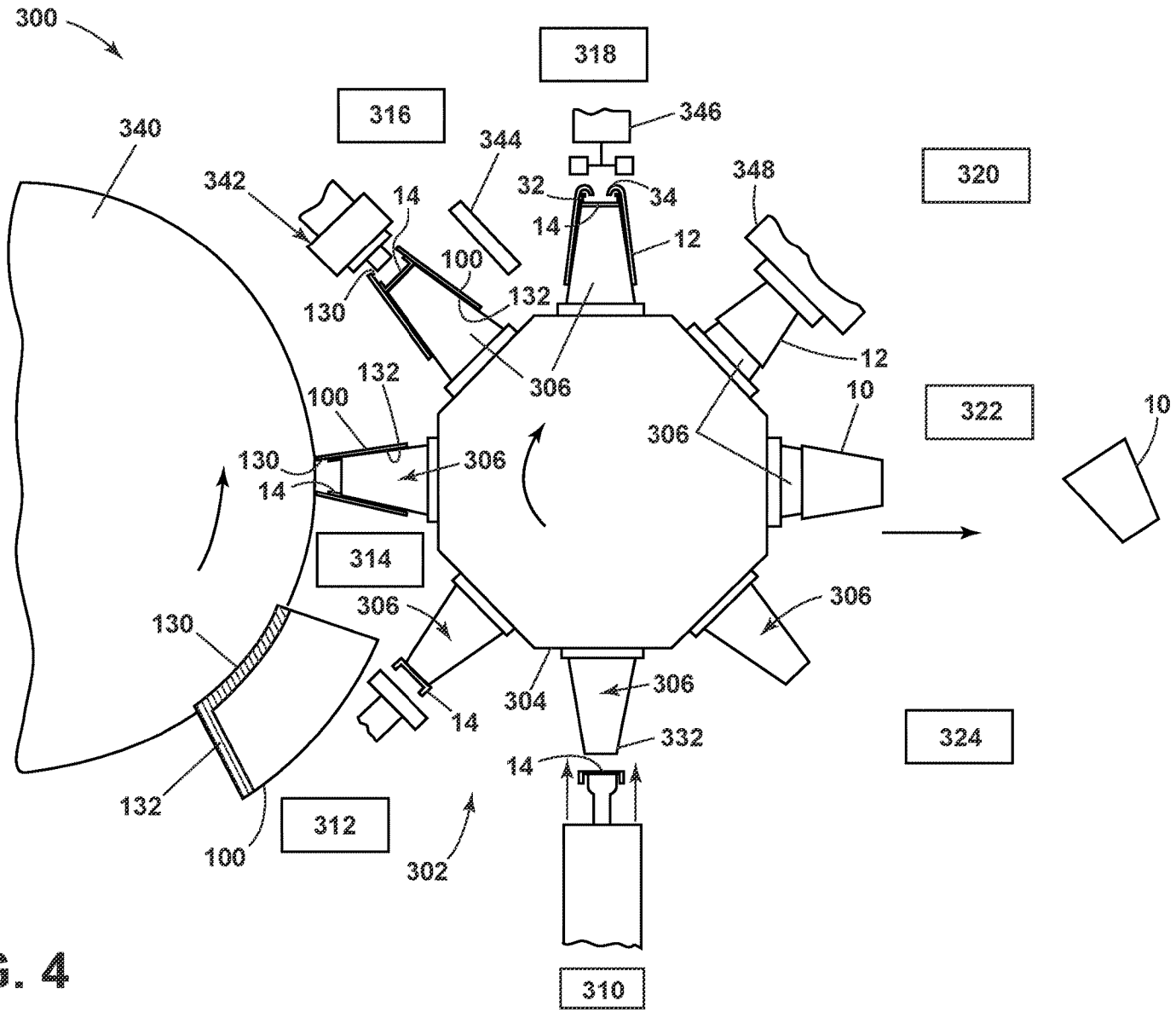
FIG. 4 is a schematic of a process of forming a container at a container forming station according to an aspect of the present disclosure.

FIG. 4 illustrates a container assembly process 300 according to an aspect of the disclosure for forming a container using the sleeve blank 100 produced according to the process 200 of FIG. 3. The process 300 is provided for illustrative purposes and may proceed in a different logical order or additional or intervening steps may be included, unless otherwise noted. While the process 300 is described in the context of forming the container 10, the process 300 may be used in a similar manner to form other types of two-piece paper containers.

The process 300 can be implemented at a container forming station 302 that includes a container forming machine including multiple forming stations 310-324 for assembling the sleeve blank 100 and the bottom blank for forming the container 10. The container forming machine can include a forming turret 304 having a plurality of forming mandrels 306 that can be indexed by the forming turret 304 to each of the forming stations 310-324.

The container assembly process 300 begins at 310 with providing the bottom 14 to an end section 332 of the mandrel 306. The bottom 14 can be held in place on the end section 332 by a vacuum. The bottom 14 can be a blank cut and formed from a paper web prior to providing the bottom 14 to the container forming station 302. Optionally, the container forming station 302 includes a bottom forming station 312 in which a pre-cut bottom blank is bent to form or re-form the bottom 14 having a bottom wall 30 and the depending skirt 32. Optionally, the container forming station 302 includes a bottom blank cutting station (not shown), in which the bottom blank is cut from a paper web prior to station 310 or 312.

At station 314 a transfer turret 340 provides a sleeve blank 100 to a wrapping apparatus (not shown) that wraps the sleeve blank 100 around the mandrel 306 and the bottom 14. The sleeve blank 100 is provided to the mandrel 306 with the printed adhesive bottom flange portion 130 and the printed adhesive seam portion 132 facing toward the mandrel 306. The wrapping apparatus wraps the sleeve blank 100 around the mandrel 306, including the bottom 14 carried by the mandrel 306, such that the printed adhesive seam portion 132 overlaps the opposing side edge and the printed adhesive bottom flange portion 130 overlaps the bottom 14.

At station 316 the printed adhesive bottom flange portion 130 and the printed adhesive seam portion 132 can be heated in one or more stages simultaneously or sequentially. In the process 300 illustrated, a bottom heater 342 is moved into position in the open bottom end of the wrapped sleeve blank 100 to heat the printed adhesive bottom flange portion 130. A seam clamp 344 can be moved into position relative to the overlapped printed adhesive seam portion 132 to apply heat and/or pressure to heat-seal the overlapped side edges of the sleeve blank 100 with the printed adhesive seam portion 132. The seam clamp 344 can provide heat and/or pressure to the printed adhesive seam portion 132. Optionally, the seam clamp 344 applies only pressure and an optional separate heating device is provided for heating the printed adhesive seam portion 132. Heating of the printed adhesive bottom flange portion 130 and the printed adhesive seam portion 132 can be obtained using any suitable heating device or combination of heating devices including radiant heat and heated air diffusers. Optionally, the printed adhesive in the bottom flange and seam portions 130, 132 can be heated while the sleeve blank 100 is on the transfer turret 340, prior to wrapping the sleeve blank 100 onto the mandrel 306 at station 314. Optionally, if heat is not necessary to achieve the desired seal, then only pressure is applied to the seams.

The mandrel 306 is next indexed to station 318 where a bottom curl forming tool 346 is moved into position to fold the flange 34 including the printed adhesive bottom flange portion 130 around the skirt 32 of the bottom 14. Heat from the bottom heater 342 applied at station 316 can soften the adhesive on the printed adhesive bottom flange portion 130 to facilitate adhesion of the flange 34 to the skirt 32. At station 320, bottom clamp 348 is utilized to apply pressure to the folded flange 34 to facilitate heat-sealing the printed adhesive bottom flange portion 130 to the skirt 32 to form the bottom seal 38 between the sleeve 12 and the bottom 14.

The mandrel 306 is then indexed to station 322 where the formed container 10 is ejected. The free mandrel 306 is indexed to station 324 where it is in position to receive the next bottom 14 at station 310. Optionally, the formed container 10 is sent to a waxing station to apply a wax barrier coating to at least the interior of the container 10 to form a waxed paper cup.

According to one aspect, the formed container 10 may be ejected to a rimming station (not shown) that curls or folds the top edge 102 to form the rim 18. The portion of the sidewall seam 22 near the top edge 102 that forms the rim 18 can be stretched during the rimming process, which can decrease the strength of the seal of the sidewall seam 22 in the rim 18 if an adhesive is not used. Printing the adhesive on the seam portion 116 according to the present disclosure addresses these challenges in maintaining the strength of the sidewall seam seal in the area of the rim 18 while allowing the cup forming process to proceed at acceptable rates.

The forming turret 304 rapidly indexes the sleeve blank 100 and the bottom 14 through the various stations 310-324 to form the container 10. A delay or pause at any of the stations 310-324 can result in a decrease in the rate of formation of the container 10. Decreases in the rate of formation decrease the number of containers 10 formed, which can increase production times and costs.

Figure 5:
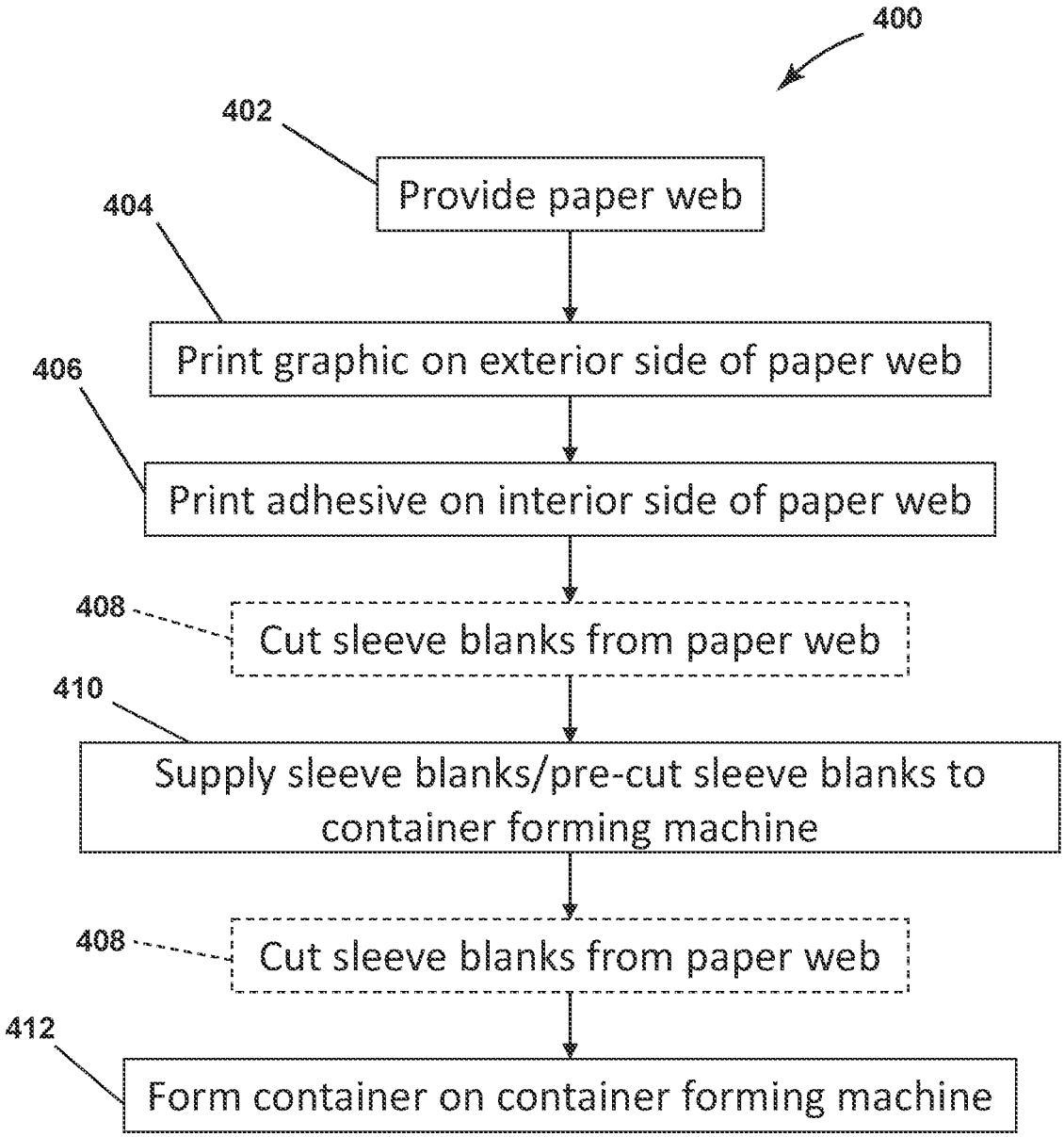
FIG. 5 is a flowchart illustrating a process of forming a container according to an aspect of the present disclosure.

FIG. 5 illustrates a process 400 for forming a two-piece paper container according to an aspect of the disclosure using a paper sleeve blank and paper bottom blank. The process 400 is provided for illustrative purposes and may proceed in a different logical order or additional or intervening steps may be included, unless otherwise noted. While the process 400 is described in the context of forming the container 10 from sleeve blank 100, the process 400 may be used in a similar manner to form other types of two-piece paper containers using other suitable sleeve blanks.

The process 400 begins at 402 with providing a paper web to a printing assembly. The printing assembly can include one or more ink printing stations for printing graphic on the paper web and one or more adhesive printing stations for printing an adhesive on the paper web. An example of a suitable printing assembly is shown in FIG. 3 with respect to the printing assembly process 200.

At 404 graphics are printed on an exterior side of the paper web by passing the paper web through one or more ink printing stations. The exterior side of the paper web is defined herein as the side of the paper web that will form the exterior of the container formed using the sleeve blanks cut from the paper web. At 406 an adhesive is printed on the other side of the paper web corresponding to the side that will form the interior of the formed container. The adhesive is printed at 406 in register with the graphic printed at 404 such that each sleeve blank cut from the printed web includes the graphic on one side and the printed adhesive on the other side in the desired locations on the sleeve blank for forming the container. The adhesive is printed on the interior of the paper web in areas corresponding to portions of the sleeve blank that will form the sidewall seam and the bottom seal in the formed container, such as described with respect to the sleeve blank 100 of FIG. 2.

An exemplary process for printing the graphic and the adhesive on the paper web is shown with respect to the printing assembly process 200 of FIG. 3. As illustrated in FIG. 3, a turn-bar roller, for example, can be used at the turn bar station 218 to flip the paper web to allow for in-line printing of the graphic on one side and the adhesive on the other side. Optionally, alternative methods for flipping the paper web in-line or for printing the adhesive without flipping the paper web can be used.

The graphic printing and adhesive printing at 404 and 406 produce a printed paper web that is optionally supplied to a blank cutter at 408 for cutting the sleeve blanks from the printed paper web. The pre-cut sleeve blanks can then by supplied to a two-piece container forming machine at 410, such as the two-piece container forming station 302 of FIG. 4. Optionally, the printed paper web can be supplied to the two-piece container forming machine at 410 and the container forming machine can include a blank cutting station to cut the sleeve blanks from printed paper web.

At 412, the two-piece container forming machine can form the container using the sleeve blank according to the present disclosure and a bottom blank. The sleeve blank can be wrapped around a bottom blank such that the printed adhesive forms a sidewall seam and a bottom seal to form the two-piece paper container. An exemplary process 300 for assembling a container according to the present disclosure is illustrated in FIG. 4.

Commercial two-piece container forming machines are capable of forming upwards of 300 containers per minute. However, this high rate of container forming can be challenging to realize for containers made from paper that does not include a polyethylene-based coating, such as waxed containers. Aspects of the present disclosure provide a container forming assembly, process, and sleeve blank which can be used to form containers using paper that is free of polyethylene-based coatings on a container forming machine at rates comparable to containers made from polyethylene-based coated paper.

Earlier two-piece paper container forming machines had much slower production rates than the 300 containers per minute rate of current machines. As polyethylene-based coated containers came into the market, the rate at which the container forming machines can form a container has also increased. The polyethylene-based coating acts as a barrier coating to protect the paper substrate, but is also heat sealable and thus acts as an adhesive for forming the container, thus removing the need to have an adhesive applying station as part of the container forming machine. Removing the adhesive applying station from the container forming machine increases the rate at which the machine can be operated and thus contributes to increasing the rate at which polyethylene-based coated containers are formed.

There is a desire in some markets to move away from polyethylene-based coated containers and utilize containers that include an aqueous-based barrier coating or are wax coated. Polyethylene-based coated containers can be challenging to recycle, whereas certain wax and aqueous-based barrier coatings may be more amenable to recycling and/or biodegrading. However, it has been challenging to identify aqueous-based barrier coatings that are heat-sealable for forming the sidewall seam and bottom seal in the containers at rates comparable to traditional polyethylene-based coatings.

Aspects of the present disclosure relate to printing an adhesive on a sleeve blank prior to providing the sleeve blank to the container forming machine. The adhesive can be printed using flexography or gravure printing on the sleeve blank, in-line with the ink printing process that prints graphics on the container. In this manner, application of the adhesive is not a rate limiting step in the container forming process. In addition, the use of flexography or gravure printing allows for more uniform, consistent, and precise printing of the adhesive on the sleeve blank compared to other traditional styles of applying adhesive. By printing the adhesive offline of the container forming machine using flexography or gravure printing, the adhesive can be applied such that the formed container cavity is free of adhesive.

To the extent not already described, the different features and structures of the various embodiments of the present disclosure may be used in combination with each other as desired. For example, one or more of the features illustrated and/or described with respect to one of the container 10, sleeve blank 100, or processes 200, 300, and 400 can be used with or combined with one or more features illustrated and/or described with respect to the other of the container 10, sleeve blank 100, or processes 200, 300, and 400. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While aspects of the present disclosure have been specifically described in connection with certain specific embodiments thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A method of forming a container from a sleeve blank and a bottom blank, the sleeve blank defined by a pair of opposing side edges and opposing top and bottom edges, and the bottom blank including a bottom wall for closing one end of the container, the method comprising:

printing a second coating of an adhesive on a sleeve blank having a first coating of the adhesive such that the second coating overlies at least a portion of the first coating, resulting in an adhesive portion having a combined thickness of the first and second coatings, wherein the adhesive portion extends along at least one of the side edges of the sleeve blank;

after printing, supplying the sleeve blank to a container forming station and wrapping the sleeve blank into a sleeve such that the side edges overlap and adhere together the overlapping side edges with the adhesive portion to form a seam seal along the overlapping side edges of the sleeve; and securing the bottom blank to the sleeve.

2. The method of claim 1 where the adhesive portion extends along at least one of the side edges and one of the top or bottom edges.

3. The method of claim 2 wherein the adhesive portion extends along one of the side edges and the bottom edge.

4. The method of claim 3 wherein the adhesive portion extends along one side edge and the bottom edge.

5. The method of claim 4 wherein the adhesive comprises at least one of a heat activated adhesive, a pressure activated adhesive, acrylic co-polymer dispersion-based adhesives, aqueous polyethylenimine-based adhesives, or barrier coating.

6. The method of claim 5 further comprising printing the second coating on a first surface of the sleeve blank and printing a graphic on a second surface of the sleeve blank, opposite the first surface, of the sleeve blank.

7. The method of claim 6 further comprising printing at least one of the second coating or graphic prior to cutting the sleeve blank from a web.

8. The method of claim 7 wherein the printing at least one of the second coating or graphic are both prior to cutting the sleeve blank from the web.

9. The method of claim 8 wherein the printing at least one of the second coating is prior to supplying the sleeve blank to the container forming station.

10. The method of claim 9 wherein the amount of printed adhesive forming the seam seal is 0.2 to 0.7 wt. % of the container.

11. The method of claim 1 wherein the adhesive is a barrier coating.

12. The method of claim 11 wherein the barrier coating is a polyethylene-based barrier coating.

13. The method of claim 1 further comprising printing the second coating on a first surface of the sleeve blank and printing a graphic on a second surface of the sleeve blank, opposite the first surface, of the sleeve blank.

14. The method of claim 13 further comprising printing at least one of the second coating or graphic prior to cutting the sleeve blank from a web.

15. The method of claim 14 wherein the printing at least one of the second coating or graphic are both prior to cutting the blank from the web.

16. The method of claim 1 wherein the printing at least one of the second coating is prior to supplying the sleeve blank to the container forming station.

17. The method of claim 1 wherein the amount of printed adhesive forming the seam seal is 0.2 to 0.7 wt. % of the container.

18. A method of forming a container from a sleeve blank and a bottom blank, the sleeve blank defined by a pair of opposing side edges and opposing top and bottom edges, and the bottom blank including a bottom wall for closing one end of the container, the method comprising:

passing a web having a first coating of an adhesive through an adhesive printing station;

printing a second coating of the adhesive on a sleeve blank having a first coating of the adhesive such that the second coating overlies at least a portion of the first coating, resulting in an adhesive portion having a combined thickness of the first and second coatings, wherein the adhesive portion is in registry with at least one of the side edges of the sleeve blank;

cutting the sleeve blank from the web such that the adhesive portion is along at least one of the side edges of the sleeve blank;

after cutting, supplying the sleeve blank to a container forming station and wrapping the sleeve blank into a sleeve such that the side edges overlap and adhere together the overlapping side edges with the adhesive portion to form a seam seal along the overlapping side edges of the sleeve; and securing the bottom blank to the sleeve.

19. The method of claim 18 wherein the printing of the second coating comprises printing along one of the side edges and the bottom edge.

* * * * *